US005549491A

United States Patent [19]

Domancic

[11] Patent Number: 5,549,491

[45] Date of Patent: Aug. 27, 1996

[54] FIN DRIVE FOR A WATERCRAFT

[76] Inventor: Tomislav Domancic, pok. Mihe, 58450 Hvar - Majerovica, Croatia

[21] Appl. No.: 422,201

[22] Filed: Mar. 29, 1995

[51] Int. Cl.[6] ..... B63H 1/36

[52] U.S. Cl. ..... 440/15; 440/32

[58] Field of Search ..... 440/13–16, 32, 440/25; 416/79, 81

[56] References Cited

U.S. PATENT DOCUMENTS

| | | | |
|---|---|---|---|
| 1,006,118 | 10/1911 | Napier . | |
| 3,464,380 | 9/1969 | Thorden | 440/13 |
| 4,490,119 | 12/1984 | Young . | |
| 5,127,855 | 7/1992 | Heywood | 440/14 |

FOREIGN PATENT DOCUMENTS

| | | | |
|---|---|---|---|
| 2727042 | 2/1978 | Germany . | |
| 8138116 | 1/1983 | Germany . | |
| 4232654 | 3/1994 | Germany | 440/25 |
| 1438768 | 6/1976 | United Kingdom . | |

*Primary Examiner*—Sherman Basinger

*Attorney, Agent, or Firm*—Flynn, Thiel, Boutell & Tanis, P.C.

[57] ABSTRACT

A fin drive for a watercraft (1) has a lever arm (7, 7') operable with muscle force, which lever arm is connected to an up and down movable carrier (2) through a joint, on which the fin (25) is fastened. The fin (25) is fastened on the carrier (2) on a swivel axis (37) extending transversely in a travelling direction. A rod (26, 27), which can be moved up and down against the force of springs (69 to 72) relative to the carrier (2), is arranged on the front side and the backside of the carrier (2). The fin (25) is pivotally arranged about an axis (36, 38) parallel to the carrier swivel axis (37) on each rod (26, 27). The stroke of the rods (26, 27) can be adjusted relative to the carrier (2).

9 Claims, 5 Drawing Sheets

FIN DRIVE FOR A WATERCRAFT

FIELD OF THE INVENTION

The invention relates to a fin drive for a watercraft, which fin drive can be operated by muscle force and includes a lever arm connected through a vertically moveable carrier to a fin.

DESCRIPTION OF THE RELATED ART

Such a drive is already known (DE-U-8138116). The fin is thereby fastened so as to be fixed against rotation on the fin carrier and can be moved up and down through a joint by a balance pivotal about a transverse axis. The known drive requires a high amount of force.

The purpose of the invention is therefore to create a fin drive for a watercraft, which, using little force, results in a high maintainable speed of the watercraft.

SUMMARY OF THE INVENTION

This purpose is attained according to the invention with the fin drive for a watercraft having a moveable lever arm joined to a moveable carrier and rods through a swivel joint, with the rod moveable and adjustable with respect to the carrier, and a fin attached to both the carrier and the rods.

The basis of the invention is the realization that large fin deflections are only needed during the start, thus generally for the acceleration of the watercraft. However, when the watercraft has reached a higher speed, large fin deflections merely increase the force consumption without further increasing the travelling speed.

Thus the deflection of the fin can according to the invention be adjusted during travel, namely through the fin carrier, and thus from the watercraft. Thus a relatively large fin deflection is adjusted with the fin drive of the invention during the start. The fin deflection is then reduced during an increase of speed of the craft so that, when the watercraft has reached a specific maintainable or travelling speed, the fin thereafter carries out only short deflections, which require a small amount of force.

The fin drive of the invention is suited for many different watercrafts and also, for example, for underwatercrafts for divers. It is particularly suited for surfboards.

BRIEF DESCRIPTION OF THE DRAWINGS

One embodiment of the invention will be discussed in greater detail hereinafter in connection with the drawings, in which.

DETAILED DESCRIPTION

Figure 1:
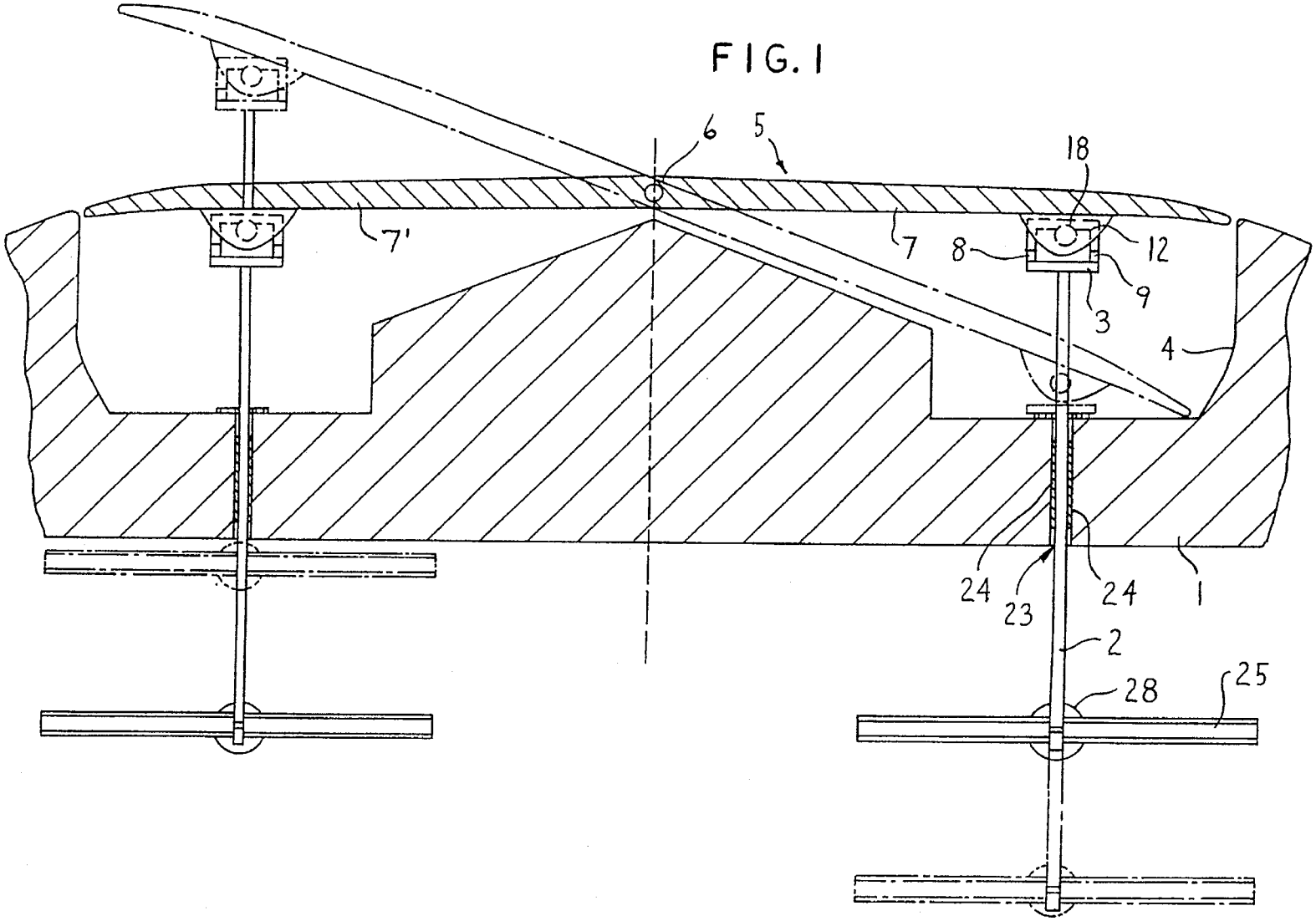
FIG. 1 is a cross section of a surfboard with a fin drive.

A platelike fin carrier 2 extends according to FIG. 1 through the fuselage 1 of a surfboard, with the plate 2 pointing in a longitudinal direction, and thus its small front edge points in a travelling direction.

The upper end of the fin carrier 2, which has an end plate 3 that is perpendicular with respect to the carrier 2, thus is horizontal and can be moved up and down in a recess 4 at the upper side of the surfboard 1, with FIG. 1 showing the upper end position of the carrier 2 through the end plate 3 as illustrated in solid lines, whereas the lower end position is shown proximate the end plate as illustrated in dashed lines. The end plate 3 is hinged to a balance 5, which is rotatable about an axis 6 extending in the travelling direction, and thus, for example, about the longitudinal axis of the surfboard.

The balance 5 extends with the lever arm 7 into the recess 4 at the upper side of the surfboard. The other lever arm 7' of the balance 5 engages a corresponding recess in the upper side on the other side of the surfboard.

At the same time, the balance 5 is a lid for closing off the recess 4. This means that when the fin drive is not needed, for example during the sailing operation of the surfboard, the balance 5 is moved into the upper position illustrated in FIG. 1 and is locked with a device (not illustrated) in this position so that the upper side of the surfboard is closed.

Figure 5:
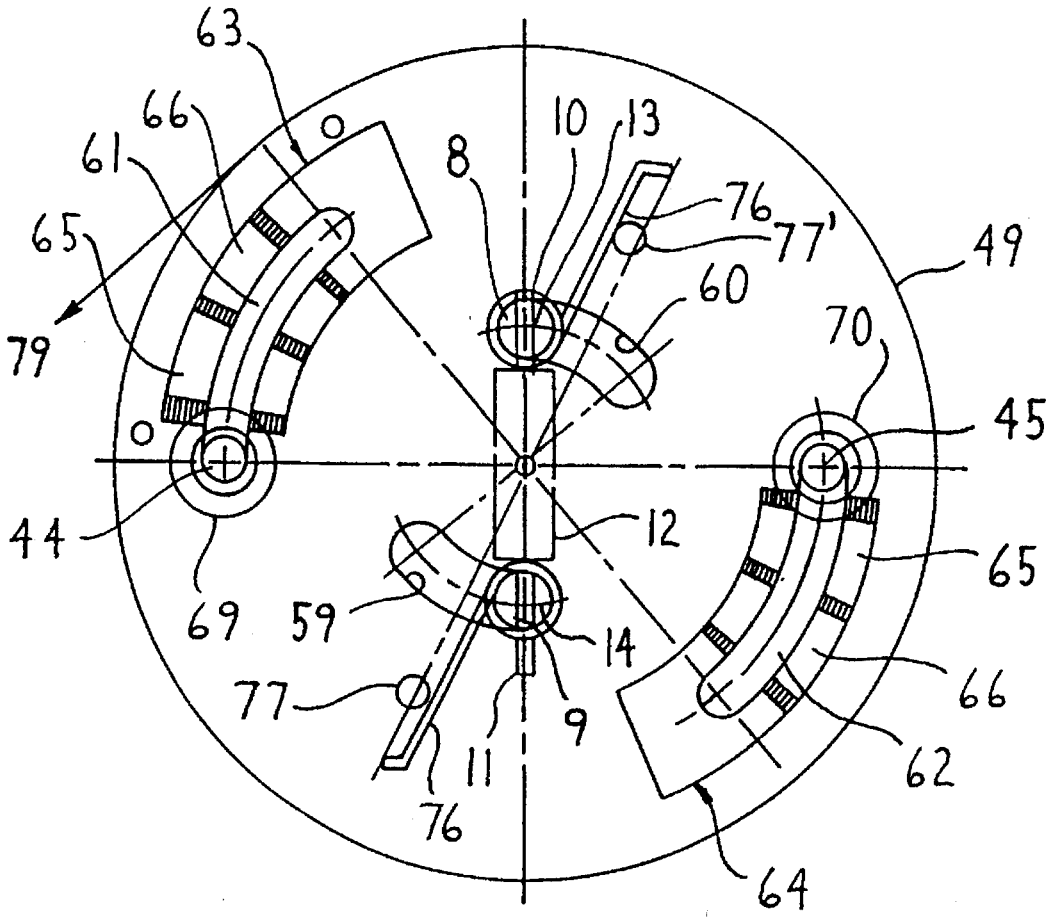

The lever arm 7 of the balance 5 is hinged to the end plate 3 by two bolts 8, 9, which have longitudinal slots at their upper end, into which slots extend the two correspondingly narrowly designed ends 10, 11 of a crossbolt 12. Locking pins 13, 14 extend through the slots in the bolt 8, 9 and the ends 10, 11 of the crossbolt 12 (FIG. 5).

Figure 2:
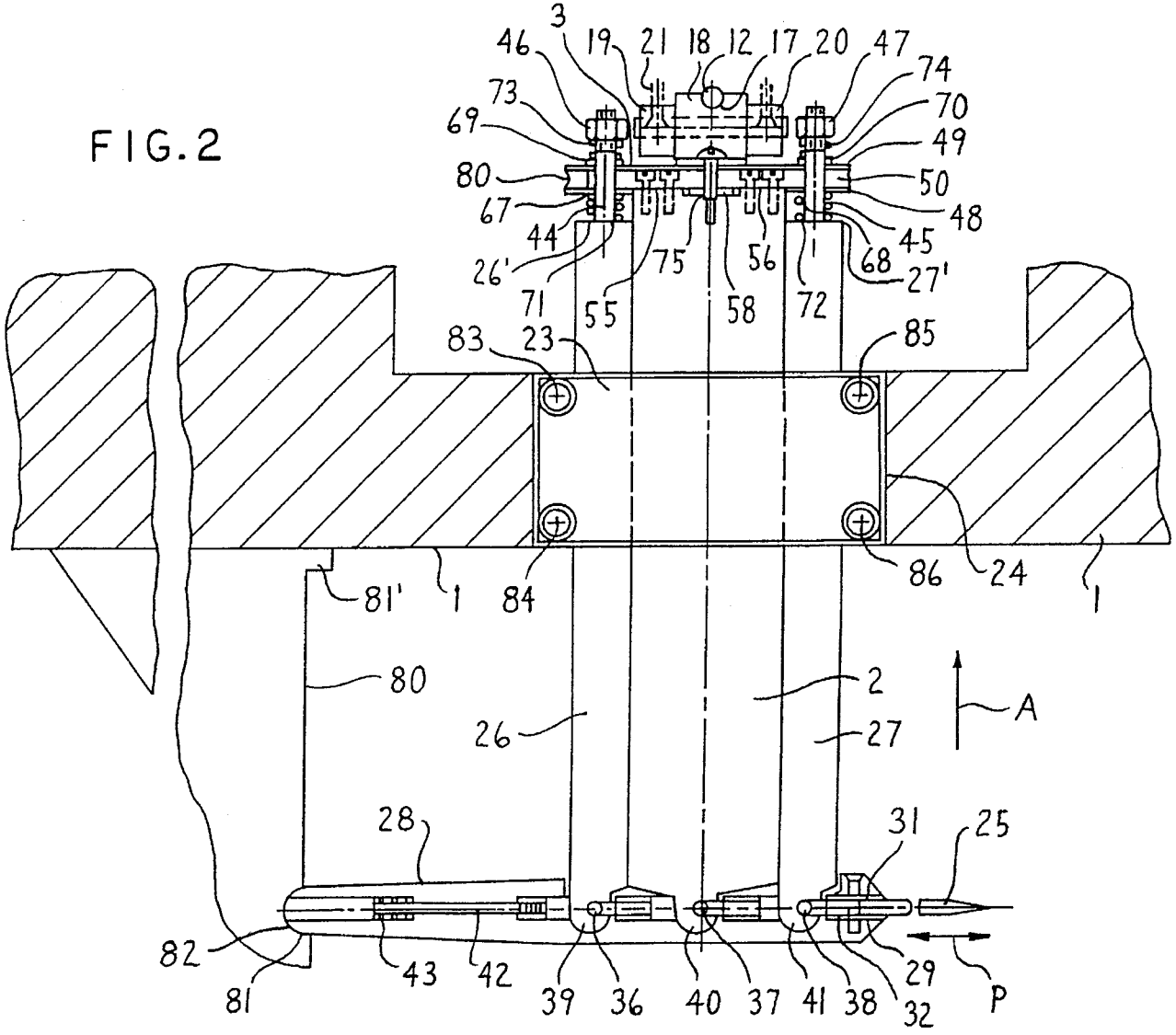
FIG. 2 is a side view of the fin carrier.

The crossbolt 12 lies, as can be seen in FIG. 2, in the peripheral groove 17 of a roller 18. The journal bearings 19, 20 of the roller 18 are fastened to the balance 5 by screws 21, 22. The crossbolt 12 thus extends between the roller 18 and the underside of the balance 5.

The fin carrier 2 is guided movably up and down in a longitudinal slot 23 in the fuselage 1. Guide plates 24, 24' are for this purpose arranged on the longitudinal sides of the slot 23.

When the balance 5 is tilted from the upper, horizontal position downwardly into the position shown in dashed lines, the fin carrier 2 moves downwardly, and vice versa.

Figure 3:
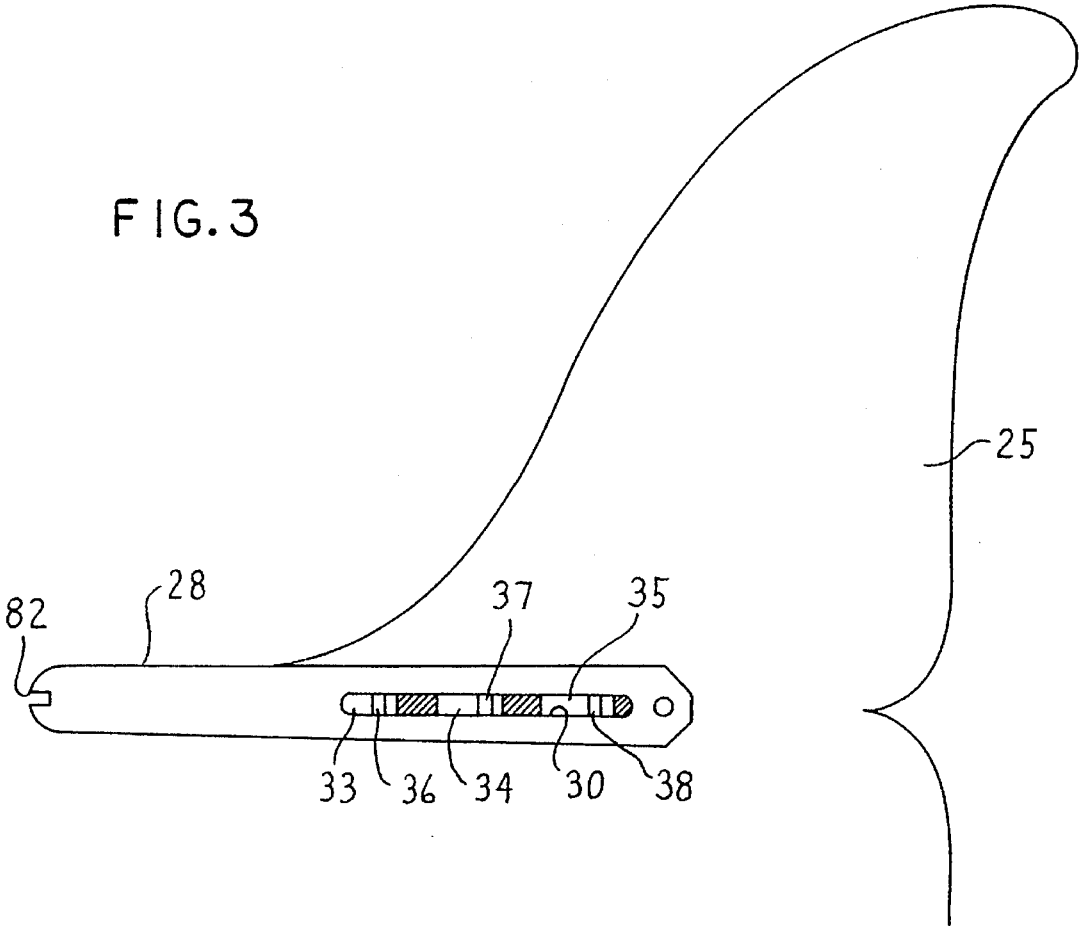
FIG. 3 is a top view of one half of the fin.

The fin 25 is fastened with its front end section on the fin carrier 2, which fin is also moved up and down with this. The fin 25 is increasingly flexible in a downward direction, for example, by reducing its thickness. The fin 25 is in the rest position fastened on the carrier 2 at a right angle. It can, for example, be shaped like a dolphin's tail fin, namely it is designed approximately sickle-shaped in the top view, with the tips of the sickle pointing downwardly (FIG. 3).

By moving the front part of the fin 25 up and down, the rear flexible part of the fin 25 is bent, namely the rear section of the fin 25 deflects relative to the horizontal, which deflections result in the forward movement of the watercraft.

The deflection of the fin 25, and thus the movement of the fin end relative to the horizontal, can be adjusted during travel in the drive of the invention.

The deflection of the fin 25 is adjusted with two rods 26, 27, which extend along the front or rather rear edge of the plate-shaped fin carrier 2.

The fin carrier 2 and the two rods 26, 27 are connected to the fin 25 by a locking mechanism. A cylindrical member 28 tapering toward its front end is provided for this purpose according to FIG. 2, which member has a rearwardly extending longitudinal slot 29, into which the fin 25 is placed.

The member 28 has a longitudinal slot 30 at its upper half, through which the lower ends of the fin carrier 2 of the rods 26, 27 are placed.

The fin 25 has recesses 33, 34, 35 in the area of the upper opening 30 of the member 28, through which the transversely extending locking bolts 36, 37, 38 extend. Hooks 39, 40, 41 having rearwardly directed hook openings are provided at the lower ends of the fin carrier 2 and of the rods 26, 27.

As can be seen in FIG. 2, the fin 25 can be moved in accordance with the arrow P along the longitudinal slot 29 in the member 28. The hooks 39, 40, 41 can in this manner, after they are placed into the opening 30 of the member 28, be moved into the recesses 33, 34, 35 in the fin 25, when the fin 25 is pulled relative to the member 28 into its rear unlocking position.

A bolt 42 is fastened on the front end of the fin 25, which bolt extends through a bore to the front end of the member 28. The fin 25 is biased into its front locking position by a spring 43 engaging the bolt 42. This means that when the fin 25 is tightened with the spring 43 and the hooks 39, 40, 41 are in the recesses 33, 34, 35 of the fin 25, the locking bolts 36, 37, 38 engage the hooks 39, 40, 41 so that the fin carrier 2 and the rods 26, 27 are locked to the fin 25.

The fin 25 is reinforced in the area of the recesses 33, 34, 35 at its upper and underside by reinforcing plates 31, 32.

Figure 6:
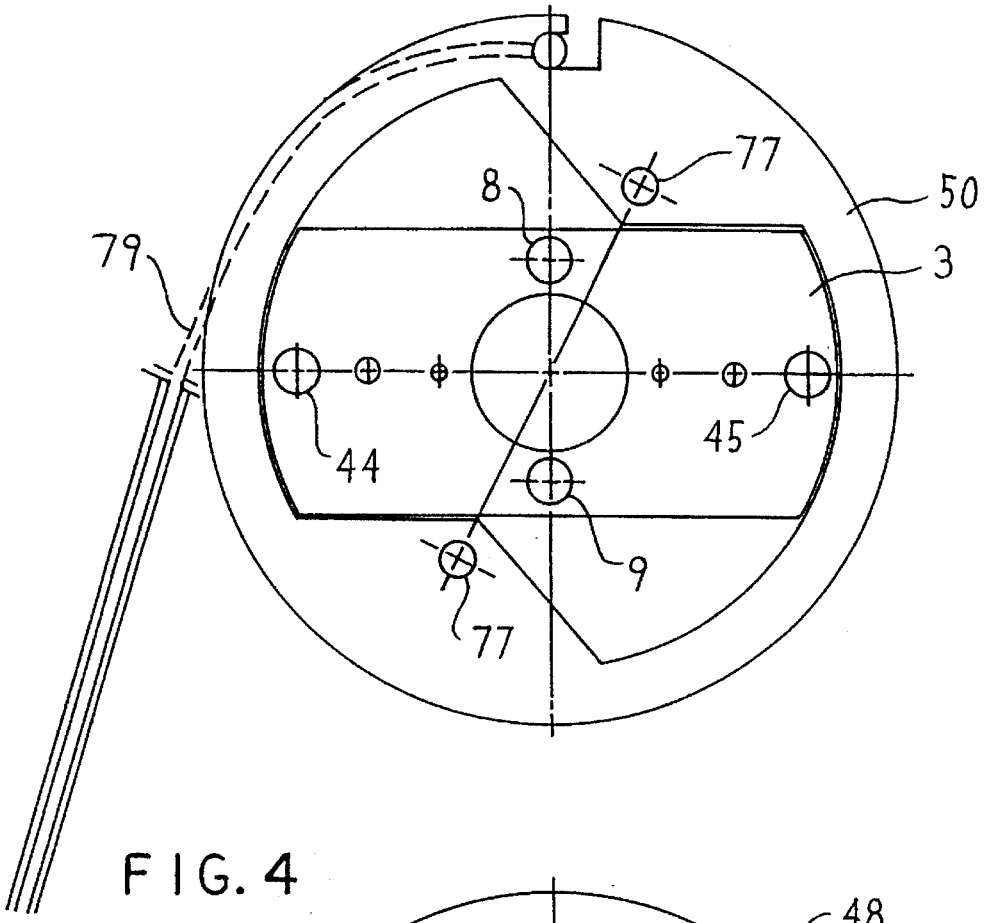
FIG. 6 is a top view of the intermediate ring between the lower and the upper plates.

The two rods 26, 27 each have at their upper ends one pin 44, 45. The pins 44, 45 project through corresponding bores 46, 47 at the front or rather rear end of the end plate 3 fastened on the carrier 2 (FIG. 6). The nuts 46, 47 are screwed to the upper end of the pins 44, 45.

A plate 48 lies on the underside of the end plate 3 and a plate 49 lies on the upper side of the end plate 3. A ring 50, which has at least the same thickness as the end plate 3, lies between the two plates 48, 49. The two plates 48, 49 and the ring 50 form one unit, which is rotatable about the longitudinal axis of the carrier 2.

Figure 4:
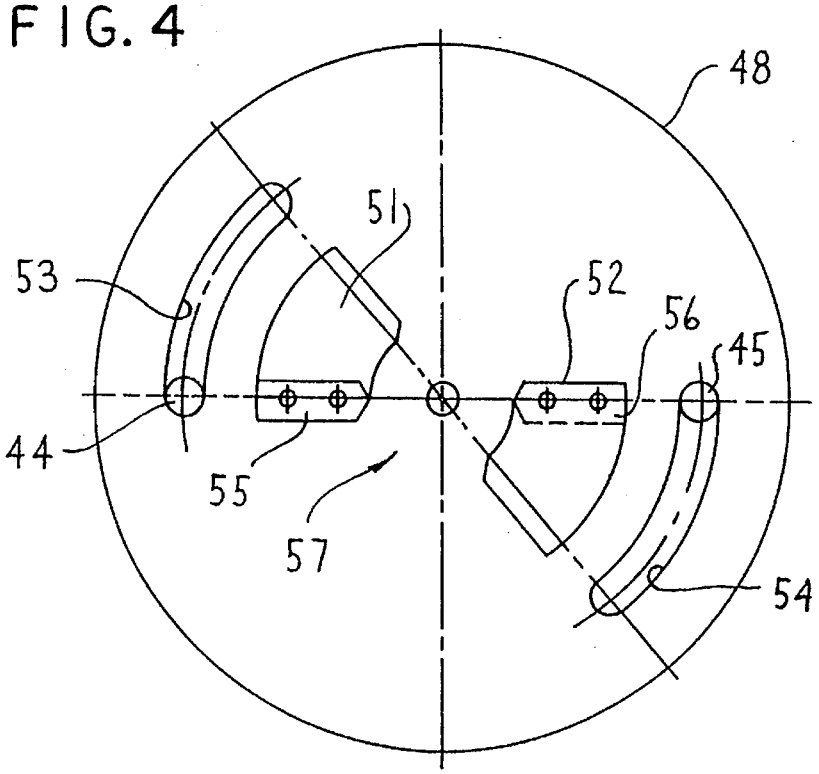
FIGS. 4 and 5 are a top view of the lower and upper plates of the stroke limiter, respectively.

According to FIG. 4, the lower plate 48 has for this purpose two inner wide curved slots 51, 52 and two outer narrow curved slots 53, 54. The slots 51 and 53 and the slots 52 and 54 lie diametrically opposite one another.

The two projections 55, 56 extend through the wide inner slots 51, 52 which projections are provided at the upper end edge of the carrier 2 and extend toward the end plate 3. The closed center area 57 of the plate 48 is thus supported in the recess 58 on the upper end edge of the carrier 2 between the two projections 55, 56 (FIG. 2). The pins 44, 45 on the rods 26, 27 extend through the outer narrow slots 53, 54.

The upper plate 49 has according to FIG. 5 two inner and two outer curved slots 59, 60 or 61, 62, which are each diametrically opposite one another, with the inner slots 59, 60 being offset at 90° with respect to the outer slots 61, 62. The bolts 8, 9, on which the cross or joint bolt 12 is fastened, extend through the inner slots 59, 60, whereas the pins 44, 45 extend through the outer slots 61, 62.

An elevation 63, 64 exists according to FIG. 5 on both sides of the outer slots 61, 62, with each elevation 63, 64 of the plate 49 increasing in two steps 65, 66. The same steplike elevations exist on the underside of the lower plate 48 along the outer slots 53, 54, however, they are not illustrated in the drawings.

Sliding plates or shoes 67, 68 or 69, 70 are movably guided on the pins 44, 45 below the lower plate 48 and above the upper plate 49. The lower sliding plates 67, 68 are supported on lower springs 71, 72, which are supported with their other ends on stops 26', 27' on the rods 26, 27 on the pins 44, 45. The upper sliding plates or shoes 69, 70 are supported through upper springs 73, 74 on the nuts 46, 47 on the pins 44, 45. The sliding plates 67 to 70 are thus pressed against the plates 48 and 49 in the area of the outer slots 53, 54 and 61, 62, where the elevations 63, 64 are.

One bolt 75 is screwed into the center of the end plate 3. It is used to fasten the end plate 3 on the carrier 2 and as an axis of rotation for the plate 49. A torsion spring is fastened on the bolt 75, the two outwardly extending ends 76, 76' of which torsion spring engage the ring 50 at 77, 77'. With this the system of the two plates 48 and 49 and the ring 50 is loaded into the position of rotation, in which the sliding plates 67 to 70 lie outside of the elevations 63, 64.

The unit of the two plates 48, 49 and the ring 50 is rotated according to FIG. 6 with a cable line 79, which is fastened on the outside on the ring 50 and which runs in a peripheral groove 80 of the ring 50.

The distance of the sliding plates 69, 70 from the nuts 46 and 47 determines the stroke of the rods 26 and 27 downwardly, and the distance of the sliding plates 67, 68 from the stops 26', 27' determines the stroke of the rods 26, 27 upwardly. The stroke in the upward direction and downward directions is of the same size.

This means that when the plates 49, 50 have been rotated relative to the sliding plates 67 to 70 with the cable line 79 such that they lie on the elevations 63, 64, then the stroke of the rods 26, 27 becomes shorter with respect to the carrier 2 and thus the deflection of the fin 25 becomes smaller. This means that when the sliding plates 67 to 70 lie outside of the elevations 63, 64, the maximum deflection of the fin 25, and thus the maximum deviation of the fin end relative to the horizonal, during movement of the fin 25 can be, for example, 10 cm, when the sliding plates 67 to 70 are rotated to the first step 65, can be for example, 5 cm, and when they are rotated to the second step 66, can be for example, 2 cm.

A centerboard 80 is arranged in front of the fin carrier 2 on the underside 1 of the watercraft, which centerboard protects the carrier 2 during travel.

A stop 81' is provided on the rear edge of the centerboard 80 in the lower area of the stop 81 and in the upper area, namely for the front end of the member 28. The member 28 has a groove 82 at its front side, into which the rear edge of the centerboard 80 extends. The groove 82 guides the member 28 along the rear centerboard edge.

The rear end of the fin 25 is pressed downwardly during the upward movement of the carrier 2 according to the arrow A, which causes the acceleration of the fin drive to be increased. This means that when the member 28 impacts the stop 81', the rear rod 27 is moved slower than the front rod 26 upwardly by suitably compressing the spring 74 in order to be then pressed upwardly. When the carrier 2 and thus the member 28 and the fin 25 move downwardly, the operation occurs in a reversed direction.

The rods 26, 27 are guided by rollers 83, 84 or 85, 86, which are arranged at the front or rather rear end of the recess 23. The lower edge of the carrier 2 extends on both sides of the axis 37 which is inclined upwardly. Also the rods 26, 27 are inclined rearwardly.

The other lever arm 7' of the balance 5 can operate a second fin in the same manner. The second fin is, however, advantageously arranged offset in the travelling direction with respect to the first fin 25.

Upper foot loops can be fastened on the balance 5, into which the surfer places his feet, when he wants to operate the fin drive with the balance 5. The balance 5 can also be designed as a seat board, on which one swings back and forth in order to operate the fin drive.

Thus the drive of the invention is particularly well suited as an auxiliary drive for surfers. The surfer can then, for example, hold onto the mast and can step the balance 5 with his feet. He can also sit or kneel on the balance 5 and can swing back and forth in order to operate the fin drive.

In particular in the case of underwatercrafts, on which the diver lies, the knees can be utilized to operate the balance 5, with the heels or feet of the diver being then advantageously placed into loops, which are fastened on the underwatercraft.

The pin 44, 45, guided through the bore of the end plate 3, is thus reciprocally unloaded with its nut stop 46, 47 at least at 50% with respect to the diametrically and diagonally oppositely positioned base stop of the rod 27, 26 during the operation of this downwardly and upwardly movably guided drive system. With this a protection against deformation and destruction is achieved during a possible excessive force of the fin 25 through the swivel axes 38, 36 onto the rods 27, 26 or rather onto the stops 47', 46', so that structural parts with smaller dimensions can be used.

The lever arm 7, 7' transmits the drive force onto the plate 3 through the joint roller 18 that has a peripheral groove 17 in which the joint bolt 12 lies, which joint bolt is fastened with the fastening bolts 8, 9 on the plate 3 in such a manner that it points in the travelling direction.

The front and the rear edges of the carrier 2 are designed concavely or convexly in cross section. The oppositely lying edges of the rods 26, 27, which edges are movably guided thereon, have a correspondingly convex or concave cross section. This causes the oppositely lying edges of the carrier 2 and of the rods 26, 27 to engage.

During the force transfer, the roller 18 is a minimum distance from the bolt 12, or rather during a load transfer the roller 18 is a distance from the end plate 3. The bolt 12 acts during a downward and upward movement of the carrier 2 onto the roller 18 in a forward or rather rearward direction below the edge of the peripheral groove 17.

The carrier 2 is guided with the rods 26, 27 by sliding plates 24, 24' mounted on both sides, which causes the force of the elastic fin tension to be transferred onto the axes of the pressure rollers 83 to 86, which axes are fastened on the fuselage 1. The rollers 83 to 86 can, if necessary, be replaced with suitable sliding bearings.

A spring can be provided on the axis 6 of the seat or rather of the balance 5, which spring holds the seat 5 parallel to the fuselage and thus, in the position shown in solid lines in FIG. 1. The seat can furthermore be locked to or unlocked from guide rollers and ropes by correspondingly eccentrically rotatable locks.

A foot loop, a handle or a mounting for the lower leg can be fastened, if desired so as to be releasable, on the lever arms 7, 7'.

The device for fastening and locking the fin 25 on the carrier 2 and the rods 26, 27 is designed such that the bearing of the axis of rotation 37 of the fin 25 on the carrier 2 and the bearing of the swivel axis 36, 38 of the fin 25 on the rod 26, 27 is rearwardly open like a hook 40 or 39, 41, wherein these hooks 39 to 41 engage the upper opening 30 of the member 28 and the separate opening 34 or 33, 35 of the reinforcing plate of the fin 25.

The pin 42 on the front part of the fin 25, which pin is guided in the front part of the member 28, is loaded in a travelling direction by the spring 43.

Toward the end of the downward and upward movement of the carrier 2, when the member 28 hits the stop 81, 81' of the centerboard 80, the remaining torsion action of the springs 71 to 74 is reinforced and the fin 25 is returned into the horizontal position.

The stops 46, 46'; 47, 47' are equal distances from the rotary plates 48, 49 in order to adjust the deflection of the fin 25. Also the springs 73, 71; 74, 72, which slide on the pins 44, 45, have the same spring force.

The carrier 2 fastened on the end plate 3 balances the fin 25, which carrier engages with its hook 40 the transversely extending axis of rotation 37 on the fin 25. The pins 44, 45 of the rods 26, 27 stabilize the fin 25 evenly in its resting horizontal and unloaded position, which pins are guided movably on the front edge and the rear edge of the carrier 2 and engage with the hooks 39, 41 the transversely extending swivel axes 36, 38 that are the same distance from the carrier swivel axis 37.

The rotary plate 48 lies below the end plate 3, which is fastened on the upper edge of the vertical plate-shaped carrier 2, and the similarly designed rotary plate 49 lies above the end plate 3. The rotary plate 48 has recesses 51, 52. The carrier 2 has at its upper end edge the center recess 58 and the projections 55 and 56 on both sides of the recess 58. Thus the lower rotary plate 48 lies with its center closed part 57 in the center recess 58 of the carrier 2, whereas the projections 55, 56 of the carrier 2 extend through the recesses 51, 52 of the rotary plate 48, which is fastened on the end plate 3.

The pins 44, 45 slide in the recesses 53, 54 of the lower rotary plate 48, the bores 44', 45' of the end plate 3 and the recesses 61, 62 of the upper rotary plate 49, which causes the rotary plate 49 to be fastened through the spacer ring 50 on the rotary plate 48 in order to form one adjusting unit 48, 49, which is rotatable about the pin 75, which, extending in the center longitudinal axis of the carrier 3, is fastened on the end plate 3.

The sliding plates 67 to 70, which are guided between the springs 71 to 74 and the unit 48, 49 on the pins 44, 45 are designed so as to be tapered toward the unit 48, 49.

The elevation is fastened with at least three parallel step positions 63', 64'; 63, 64 which have correspondingly sharp keys is fastened diametrically opposite on both sides along the recesses 53, 54; and 61, 62 of the units 48, 49. The torsion springs are fastened with their arms 76, 76' on the pins 8, 9 that are fastened on the end plate and extend through the recesses 59, 60, which springs load the ring 50 at 77, 77' and the unit 48, 49 in an opposite direction of rotation.

The nut and base stops 46, 47 and 26', 27' of the pins 44, 45 or rather of the rods 26, 27 are supported diametrically and diagonally opposite upon operation of the drive in the adjusted loaded rotary position and the first two respectively adjusted key steps 65, 66 of the unit 48, 49.

The stops 46', 47'; 46, 47 of the pins 44, 45 are provided and thus the fin 25 is immobilized in a fourth position of the elevation 63', 64'; 63, 64 and adjustment of the same is through the sliding plates 67 to 70 and the maximum compressed springs 71 to 74.

From the drive seat 5 it is possible to synchronously adjust the angle of inclination of two fins 25 through a provided operating lever with two ropes 79.

Thus the fin drive of the invention has a seat designed as a balance and pivotal on both sides, with which seat the muscle force is transmitted rectinlinearly and directly vertical, namely through the end plate 3 and the carrier 2 onto the axis of rotation 37 of the fin 25, through the stops 46, 47; 46', 47' of the pins 44, 45 of the rods 26, 27 onto the front or rather rear swivel axis 36, 38 of the fin 25, with the pins 44, 45 with their nut stops 46, 47 being reciprocally, diametrically and diagonally opposite the base stop 26, 27', thus unloading the stop pairs 46, 27' and 47, 26', so that during an excessive load on the fins 25 a protection against deformation is guaranteed. With a locking device having the hook 40 on the carrier 2 and the hooks 39, 41 on the rods 26, 27, the member 28 having the axis of rotation 37 for the carrier and the swivel axes 36, 38 for the rods 26, 27, it is possible to fasten the fin 25 with one thrust within the shortest period of time. The device for adjusting the deflection of the fin 25 is integrated into the fin drive. It has at least one rotary plate 48, 49 with key-shaped steps 63, 64; 63', 64', which cooperate with the stops 46, 47; 26', 27'.

Thus a compact reserve or main drive for a watercraft is made available, which makes possible a high travelling speed with a relatively small amount of force. The drive is suited for watercrafts for sport and leisure purposes, for rescue purposes and for the commercial transport.

I claim:

1. A fin drive for driving a watercraft in a travelling direction comprising:

a lever arm operable with a driving force and having connection means adapted to be connected to a watercraft;

a pivot joint disposed on said lever arm;

a moveable carrier connected to said pivot joint so as to be moveable along a path extending toward and away from said lever arm in response to a movement of said lever arm;

at least first and second rods provided respectively on a front side and a rear side of said moveable carrier and connected to said pivot joint so as to be moveable in conjunction with said moveable carrier, said first and second rods being moveable relative to said moveable carrier each through an adjustable stroke;

biasing means operatively engaged with said first and second rods for providing a biasing force which resists movement of said first and second rods relative to said moveable carrier through said stroke;

a fin having first swivel axis means for pivotally fastening said fin to said moveable carrier, said first swivel axis means defining a first swivel axis oriented transverse to said travelling direction, said fin including second swivel axis means for pivotally fastening said fin to said first and second rods said second swivel axis means defining a rod axis for each of said first and second rods oriented parallel with respect to said first swivel axis; and adjustment means for varying said stroke of each said first and second rods relative to said moveable carrier whereby pivoting of said fin about said first swivel axis is adjusted.

2. The fin drive according to claim 1, wherein said lever arm is pivotal about an axis extending in a travelling direction which is defined by said connection means, and said driving force is transmitted onto said carrier by a joint roller of said pivot joint fastened on said lever arm, said joint roller having a peripheral groove in which there rests a joint bolt on a side facing said lever arm, said joint bolt being fastened on said carrier.

3. The fin drive according to claim 1, further comprising a watercraft to which said lever arm is connected and guide means for said carrier and said rods formed by a plurality of sliding plates extending through a fuselage of said watercraft on opposite sides of said carrier and of said rods.

4. The fin drive according to claim 1, wherein said carrier is a plate extending in the travelling direction.

5. The fin drive according to claim 1, wherein said adjustment means includes a pin at an upper end of each of said first and second rods;

at least one rotary plate rotatably supported on an upper end of said moveable carrier and having a pair of circular recesses in said at least one rotary plate, each said pin received through a corresponding one of said circular recesses;

a pair of stops provided on each said pin of said first and second rods which are spaced apart so as to be disposed on opposite sides of said rotary plate;

a plurality of elevated surfaces differing in height along each said circular recess; and said biasing means being arranged between said stops and said rotary plate to provide said biasing force coacting between each said stop and an opposing portion of said rotary plate.

6. The fin drive according to claim 5, which includes an end plate fastened to said upper end of said moveable carrier and a set of two said rotary plates attached to said end plate on opposite sides thereof.

7. The fin drive according to claim 6, wherein said pivot joint includes a joint bolt which is fastened on said end plate with at least one fastening bolt arranged at an end of said joint bolt.

8. The fin drive according to claim 1, wherein said fin includes a member for fastening said fin on said moveable carrier and said rods, said member having an opening for receiving lower ends of said moveable carrier and of said rods, wherein said moveable carrier and said rods each having a rear opening hook-shaped portion, and wherein said first and second swivel axis means each comprise at least one crossbolt, said member having said crossbolts disposed in said opening so as to be received within respective said hook-shaped portions of said moveable carrier and said rods, said member including spring means for biasing said crossbolts into said hook-shaped portions.

9. The fin drive according to claim 8, further comprising a watercraft to which said lever arm is connected and stop means fastened on said watercraft engaging a front end of said member for limiting movement of said carrier.

* * * * *